US011585033B2

(12) United States Patent
Tong et al.

(10) Patent No.: US 11,585,033 B2
(45) Date of Patent: Feb. 21, 2023

(54) TRACK MECHANISM AND FRONT-LOADING WASHING MACHINE WITH SAME

(71) Applicant: WUXI LITTLE SWAN ELECTRIC CO., LTD., Wuxi (CN)

(72) Inventors: Shuai Tong, Wuxi (CN); Hucheng He, Wuxi (CN); Changxing Zhao, Wuxi (CN); Zhigang Liu, Wuxi (CN); Lufu Tan, Wuxi (CN); Tao Jiang, Wuxi (CN); Xin Yu, Wuxi (CN); Yusheng Tang, Wuxi (CN)

(73) Assignee: WUXI LITTLE SWAN ELECTRIC CO., LTD., Wuxi (CN)

( * ) Notice: Subject to any disclaimer, the term of this patent is extended or adjusted under 35 U.S.C. 154(b) by 598 days.

(21) Appl. No.: 16/578,151

(22) Filed: Sep. 20, 2019

(65) Prior Publication Data

US 2020/0010996 A1 Jan. 9, 2020

Related U.S. Application Data

(63) Continuation of application No. PCT/CN2017/102325, filed on Sep. 19, 2017.

(30) Foreign Application Priority Data

Mar. 29, 2017 (CN) ..... 201710199173.4

(51) Int. Cl.
*D06F 37/18* (2006.01)
*D06F 23/02* (2006.01)
(Continued)

(52) U.S. Cl.
CPC ..... *D06F 37/18* (2013.01); *D06F 23/02* (2013.01); *D06F 37/28* (2013.01); *D06F 39/14* (2013.01)

(58) Field of Classification Search
CPC ..... D06F 23/02; D06F 37/18; D06F 37/28; D06F 39/14
See application file for complete search history.

(56) References Cited

U.S. PATENT DOCUMENTS 2,639,601 A * 5/1953 Miller ..... D06F 37/14 68/210
3,328,984 A * 7/1967 Lowes ..... D06F 95/00 68/210
(Continued)

FOREIGN PATENT DOCUMENTS

CN 2729088 Y 9/2005
CN 101581528 A 11/2009
(Continued)

OTHER PUBLICATIONS

Midea Group Co., Ltd., ISRWO, PCT/CN2017/102325, dated Jan. 5, 2018, 6 pgs.
(Continued)

*Primary Examiner* — Joseph L. Perrin
(74) *Attorney, Agent, or Firm* — Morgan, Lewis & Bockius LLP

(57) ABSTRACT

A track mechanism and a front-loading washing machine are provided. The track mechanism includes a base, the base is provided with a track portion configured to guide a movable body to move along the track portion, the base includes a supporting body and a track body, the track portion is arranged on the track body, the supporting body and the track body are stacked and combined relative to each other, and wear resistance of the track body is higher than that of the supporting body.

12 Claims, 5 Drawing Sheets

(51) Int. Cl.
*D06F 37/28* (2006.01)
*D06F 39/14* (2006.01)

(56) References Cited

U.S. PATENT DOCUMENTS

| | | | | | |
|---|---|---|---|---|---|
| 3,498,089 | A * | 3/1970 | Beebe | D06F 37/28 | 68/210 |
| 3,521,319 | A * | 7/1970 | Fisher | D06F 58/04 | 126/194 |
| 6,233,980 | B1 * | 5/2001 | Kegler | D06F 43/02 | 68/210 |
| 2002/0178936 | A1 * | 12/2002 | Williams | D06B 15/02 | 100/155 R |
| 2003/0207774 | A1 * | 11/2003 | Negoro | C10M 105/70 | 544/197 |
| 2008/0295546 | A1 * | 12/2008 | Cho | D06F 39/02 | 68/17 R |
| 2011/0120195 | A1 * | 5/2011 | Jeoung | D06F 37/28 | 68/139 |
| 2011/0174021 | A1 * | 7/2011 | Lee | D06F 39/022 | 68/17 R |
| 2016/0356542 | A1 * | 12/2016 | Kim | E05D 7/1044 | |
| 2018/0073184 | A1 * | 3/2018 | Ayers | D06F 39/022 | |

FOREIGN PATENT DOCUMENTS

| | | | |
|---|---|---|---|
| CN | 102776771 | A | 11/2012 |
| CN | 203923814 | U | 11/2014 |
| CN | 203939363 | U | 11/2014 |
| CN | 104313830 | A | 1/2015 |
| CN | 104416227 | A | 3/2015 |
| CN | 105603834 | A | 5/2016 |
| CN | 105795871 | A | 7/2016 |
| EP | 1652992 | A2 | 5/2006 |
| EP | 1961856 | A1 | 8/2008 |
| JP | 2002069904 | A | 3/2002 |
| JP | 2004113480 | A | 4/2004 |
| JP | 2005262358 | A | 9/2005 |
| JP | 2012177436 | A | 9/2012 |
| WO | WO 2010128734 | A2 | 11/2010 |

OTHER PUBLICATIONS

Midea Group Co., Ltd., IPRP, PCT/CN2017/102325, dated Oct. 1, 2019, 4 pgs.
Midea Group Co., Ltd., 1st CN Office Action, CN Patent Application No. 201710199173.4, dated Oct. 25, 2018, 14 pgs.
Extended European Search Report, EP17903463.2, dated Dec. 13, 2019, 8 pgs.

* cited by examiner

TRACK MECHANISM AND FRONT-LOADING WASHING MACHINE WITH SAME

CROSS-REFERENCE TO RELATED APPLICATIONS

This application is a continuation application of PCT/CN2017/102325, filed on Sep. 19, 2017, which claims priority to Chinese Patent Application No. 201710199173.4, filed with the State Intellectual Property Office of the People's Republic of China on Mar. 29, 2017, all of which are incorporated herein by reference in their entirety.

FIELD

The present disclosure relates to a technical field of clothes treatment devices, and more particularly to a track mechanism and a front-loading washing machine with same.

BACKGROUND

In the related art, a door unit of a front-loading washing machine is connected to a bearing by means of a supporting plate, the supporting plate is provided with a track portion fitted with the bearing, and thus the support plate needs to be made of a wear-resistant material. However, as the supporting plate is a one-piece part having a simple structure, both the processability and cost are high if the whole supporting plate is made of the wear-resistant material. The wear resistance is poor and the service life is short if the whole supporting plate is made of materials which are easy to process and low in cost.

SUMMARY

The present disclosure seeks to solve at least one of the problems existing in the related art. Therefore, the present disclosure provides a track mechanism with high use reliability.

The present disclosure further provides a front-loading washing machine with the above track mechanism.

The track mechanism according to embodiments of the first aspect of the present disclosure, includes a base, the base is provided with a track portion configured to guide a movable body to move along the track portion, in which the base includes a supporting body and a track body, the track portion is arranged on the track body, the supporting body and the track body are stacked and combined relative to each other, and wear resistance of the track body is higher than that of the supporting body.

With the track mechanism according to embodiments of the present disclosure, the supporting body and the track body are made of materials different in wear resistance, and then the base is assembled by them. Because the wear resistance of the track body is higher than that of the supporting body, the wear resistance of the base is improved. With the base, it is meant to give consideration to both performance requirement and manufacturing cost requirement, i.e. the desired performance requirement can be achieved with manufacturing cost reduced, which is beneficial to improvement of cost performance of the track mechanism A.

According to an embodiment of the present disclosure, the track portion includes a plurality of tracks spaced apart from each other.

According to an embodiment of the present disclosure, the supporting body is combined with the track body by means of a connecting member.

Optionally, the connecting member is a screw.

According to an embodiment of the present disclosure, the supporting body is combined with the track body by embedding or casting in a mold.

Optionally, the track portion is an arc groove.

The front-loading washing machine according to embodiments of the second aspect of the present disclosure includes: a cabinet including a front panel, the front panel defining an opening; a tub defining an access port, arranged in the cabinet and configured to make the access port move upwards and downwards in the opening; a rotatable drum arranged in the tub; a door unit mounted to the tub and covering the access port; and the track mechanism according to above embodiments, in which the movable body is the door unit and the door unit moves upwards and downwards in the opening under guide of the track mechanism.

The front-loading washing machine according to embodiments of the present disclosure adopts the above track mechanism of the above embodiments, and the use reliability can be improved.

According to an embodiment of the present disclosure, the front-loading washing machine further includes a movable portion, the movable portion is configured to move along the track portion, and the door unit is connected to the movable portion by means of a connecting part.

Optionally, the movable portion includes a body and a moving end rotatable relative to the body, the moving end and the body are provided with a rolling body therebetween, and the moving end is configured to be embedded in the track portion and can rotate along the track portion.

Optionally, the rolling body is a ball.

Furthermore, the moving end defines a recess in a portion in contact with the track portion, and the recess is fitted with the track portion.

According to an embodiment of the present disclosure, two track mechanisms are symmetrically provided at two sides of the cabinet respectively.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and/or additional aspects and advantages of the present disclosure will become apparent and more readily appreciated from the following descriptions of embodiments made with reference to the drawings, in which.

Figure 1:
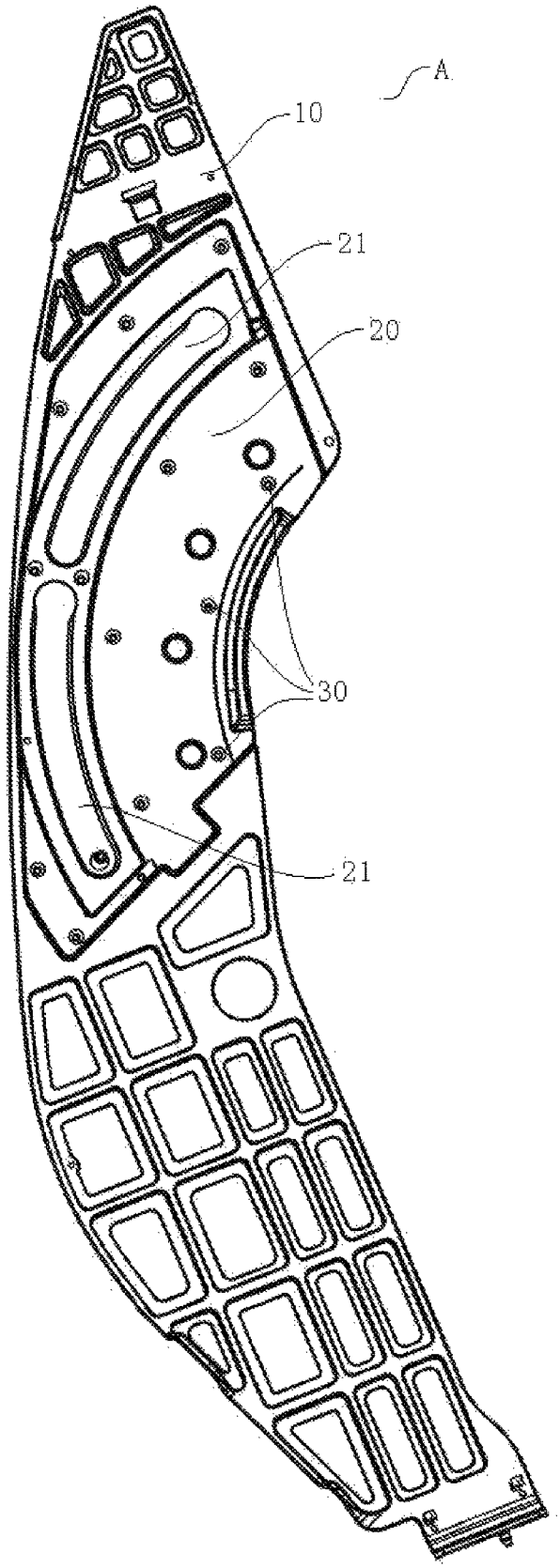
FIG. 1 is an assembly view of a track mechanism according to an embodiment of the present disclosure in accordance with some embodiments.

REFERENCE NUMERALS supporting body 10, guide portion 11, track body 20, track portion 21, connecting member 30, door unit 40, movable portion 50.

DETAILED DESCRIPTION

Embodiments of the present disclosure will be described in detail in the following, and examples of the embodiments are shown in the drawings. The same or similar elements and the elements having same or similar functions are denoted by like reference numerals throughout the descriptions. The embodiments described hereafter with reference to drawings are explanatory, used to understand the present disclosure, and shall not be construed to limit the present disclosure.

In the specification, unless specified or limited otherwise, relative terms such as "central", "thickness", "upper", "lower", "front", "rear", "left", "right", "vertical", "top", "bottom", "inner", "outer", "axial", "radial" and "circumferential" should be construed to refer to the orientation as then described or as shown in the drawings under discussion. These relative terms are for convenience of description and do not require that the present disclosure be constructed or operated in a particular orientation. Therefore, the above terms should not be construed to limit the present disclosure.

Figure 2:
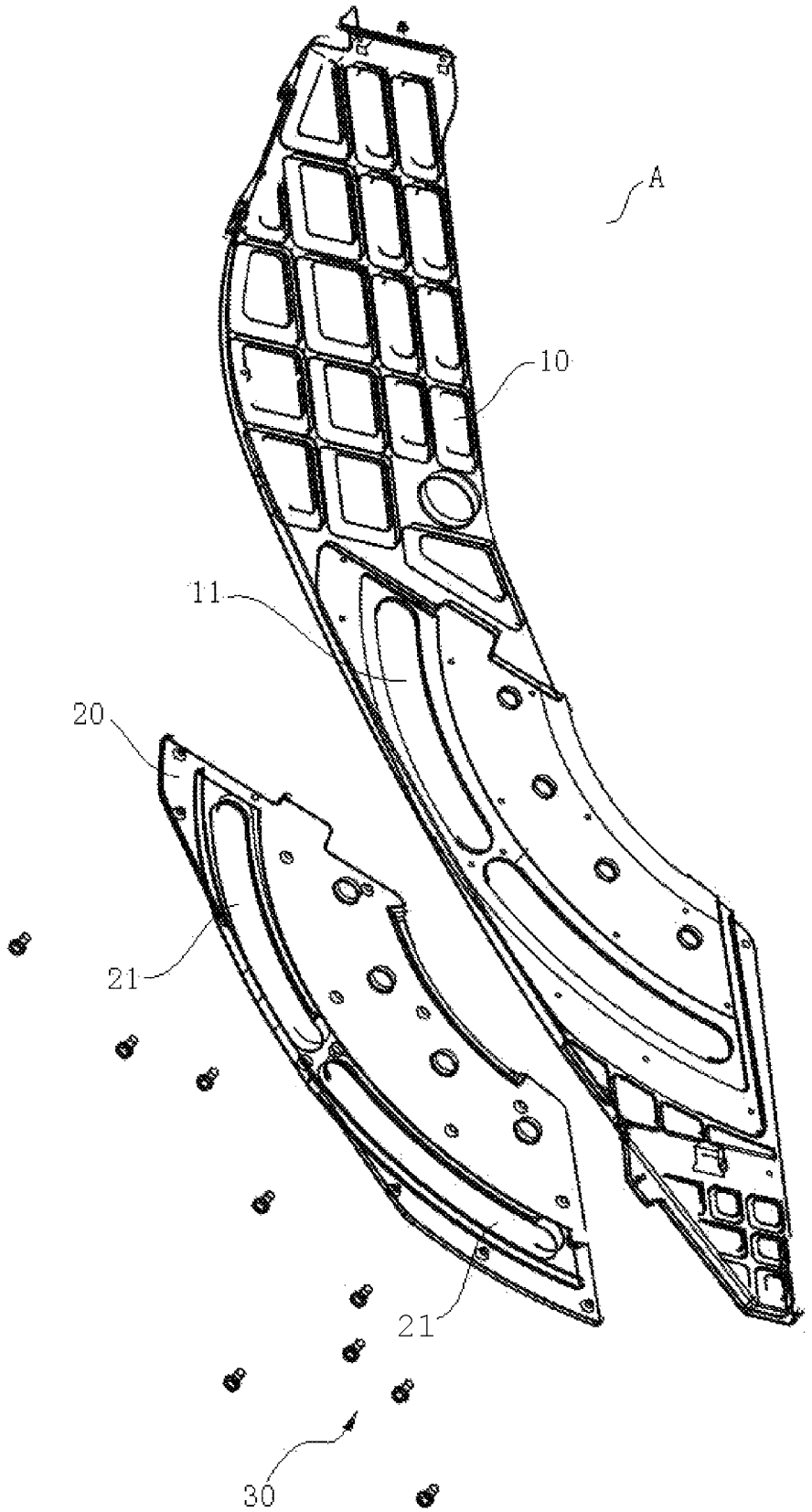
FIG. 2 is an exploded view of the track mechanism shown in FIG. 1.
Figure 3:
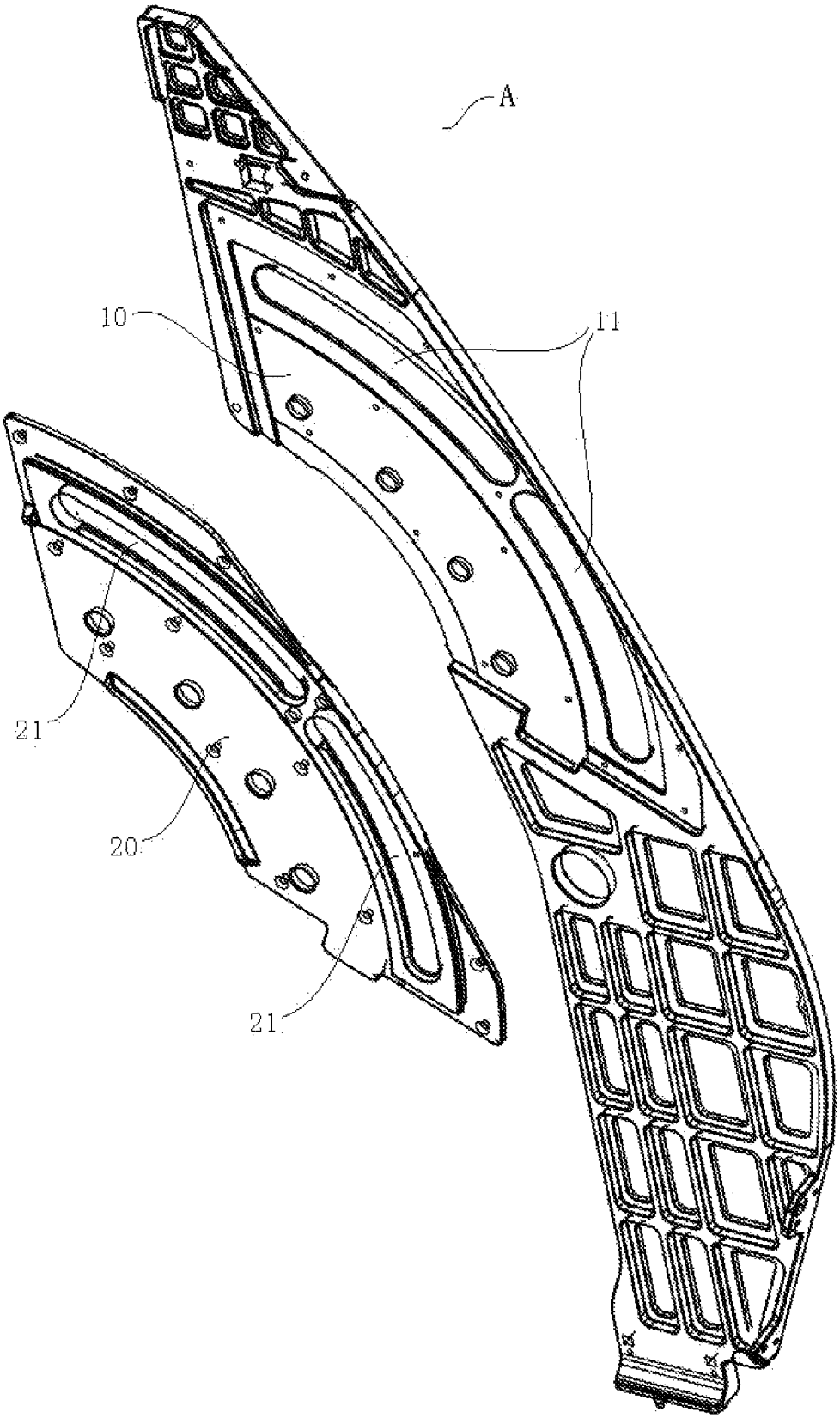
FIG. 3 is an exploded view of a track mechanism in accordance with some embodiments according to another embodiment of the present disclosure.

A track mechanism A according to embodiments of the first aspect of the present disclosure is described hereafter with reference to FIG. 1 to FIG. 3.

As shown in FIG. 1 to FIG. 3, the track mechanism A according to the embodiments of the present disclosure includes a base. The base is provided with a track portion 21 configured to guide a movable body to move along the track portion 21. The base includes a supporting body 10 and a track body 20, and the track portion 21 is arranged on the track body 20. The supporting body 10 and the track body 20 are stacked and combined relative to each other, and the wear resistance of the track body 20 is higher than that of the supporting body 10.

In the track mechanism A according to the embodiments of the present disclosure, the supporting body 10 and the track body 20 are made of materials different in wear resistance, and then the base is assembled by them. Because the wear resistance of the track body 20 is higher than that of the supporting body 10, the wear resistance of the base is improved. With the combined base, it is meant to give consideration to both performance requirement and manufacturing cost requirement, i.e. the desired performance requirement can be achieved with manufacturing cost reduced, which is beneficial to improvement of cost performance of the track mechanism A.

The supporting body 10 is provided with a guide portion 11 corresponding to the track portion 21. That is, the guide portion 11 is in a shape matching that of the track portion 21 and in a position corresponding that of the track portion 21. The track portion 21 and the guide portion 11 define arc grooves running through the track body 20 and the supporting body 10 in the thickness direction respectively. Thus, the track portion 21 and the guide portion 11 cooperatively constitute a new arc groove with a large depth.

Optionally, a surface area of the track body 20 is less than that of the supporting body 10, and the track body 20 covers on a portion of the supporting body 10 adjacent to the guide portion 11, thereby enhancing the structural strength and the wear resistance of the portion of the supporting body 10 adjacent to the guide portion 11.

In some examples, the track body 20 may be made of high-strength wear-resistant material, while the supporting body 10 may be made of high-strength low-cost material with good processability through low-cost process. Then the track body 20 is connected to the supporting body 10. Science the wear resistance of the track body 20 is higher than that of the supporting body 10, the supporting body 10 is good in processability and low in manufacturing cost, such that the combined base has advantages of both. The fit between the track body 20 and a movable portion 50 is reliable, both the performance requirement and the manufacturing cost are taken in to account, and the cost performance of the track mechanism A are therefore improved.

According to an embodiment of the present disclosure, the movable body may be connected to one movable portion, and the movable portion moves along the track portion 21. The track portion 21 includes a plurality of tracks spaced apart from each other. Correspondingly, a plurality of movable portions are provided at positions corresponding to the plurality of tracks one to one. Supporting for the movable body provided by the base is improved, and the movable body can move along the track portion 21 more smoothly and reliably.

In some examples, the track body 20 is provided with two track portions 21, and each track portion 21 is embodied as an arc groove. The two arc grooves may be distributed and spaced along a circumferential direction of the same circumference, or may be distributed and spaced along a radial direction, which will be understood by one of ordinary skill in the art.

As shown in FIG. 1 and FIG. 2, in some optional examples, the supporting body 10 is detachably connected to the track body 20 by means of a connecting member 30. For example, the connecting member 30 may include a plurality of screws, and the plurality of screws are distributed and spaced along a circumferential direction of the track portion 21, which ensures that the track body 20 is reliably connected to the supporting body 10, and the sides of the track body 20 and the supporting body 10 opposite to each other are appressed, thereby improving the overall performance of the base.

As shown in FIG. 3, in some other optional examples, the supporting body 10 is combined with the track body 20 by embedding or casting in a mold. For example, during manufacturing, the track body 20 and the supporting body 10 are provided with profilings respectively, and shapes and positions of the profilings corresponds to each other. When the track body 20 is mounted to the supporting body 10, a protruding profiling on the track body 20 is pressed into a groove profiling in the supporting body 10 to achieve stable connection therebetween, the operation is easy and the reliability of connection is high.

A front-loading washing machine according to embodiments of the second aspect of the present disclosure is described hereafter with reference to FIG. 1 to FIG. 5. It should be noted that, in the present disclosure, the front-loading washing machine may refer to a clothes treatment device capable of washing clothes, such as a washing machine or a front-loading washer-dryer.

The front-loading washing machine according to the embodiments the present disclosure includes a cabinet, a tub, a rotatable drum, a door unit 40 and the track mechanism.

According to the above embodiments, the cabinet includes a front panel, and the front panel defines an opening. The tub defines an access port. The tub is arranged in the cabinet and configured to make the access port move upwards and downwards in the opening. The rotatable drum is arranged in the tub. The door unit 40 is mounted to the tub and covers on the access port.

The door unit 40 is configured as the movable body. During operation, the door unit 40 can swing in a vertical plane along with the tub, at the same time, the door unit 40 moves upwards and downwards in the opening under guide of the track mechanism A.

The front-loading washing machine according to the embodiments the present disclosure adopts the track mechanism A including the base combined of the supporting body 10 and the track body 20, both the performance requirement and the manufacturing cost are taken in to account, and the cost performance of the front-loading washing machine can be improved on the premise that the front-loading washing machine can be reliably used.

Figure 4:
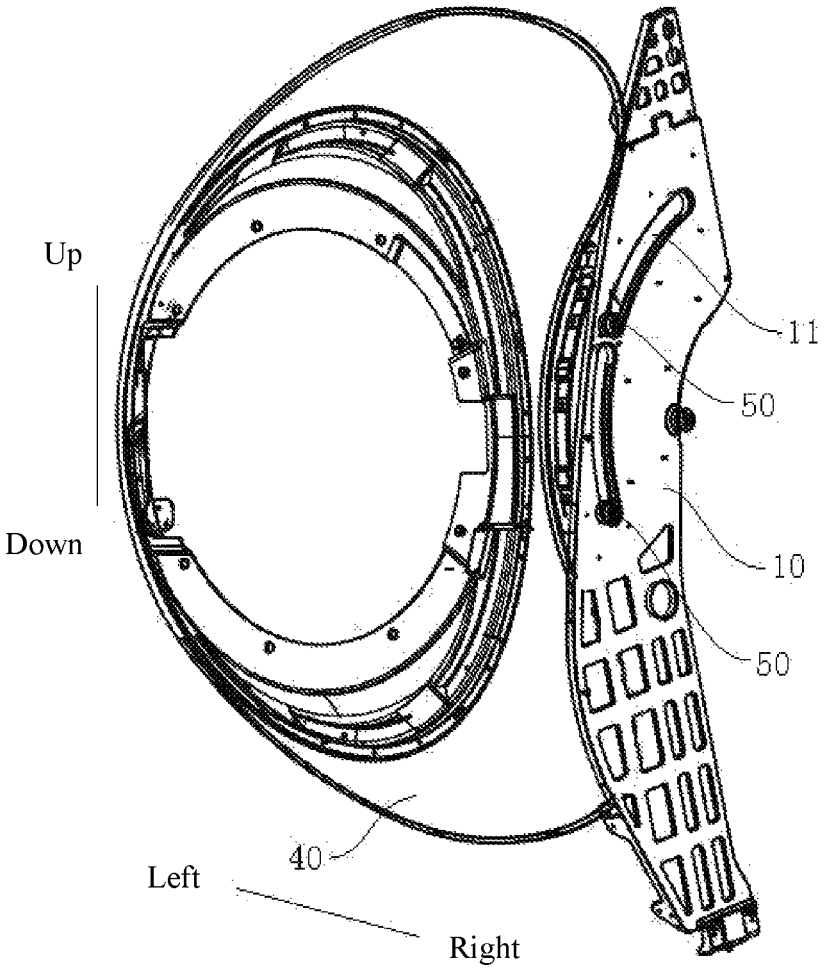
FIG. 4 is a schematic view showing that the track mechanism is mounted on a door unit according to an embodiment of the present disclosure from an angle in accordance with some embodiments.
Figure 5:
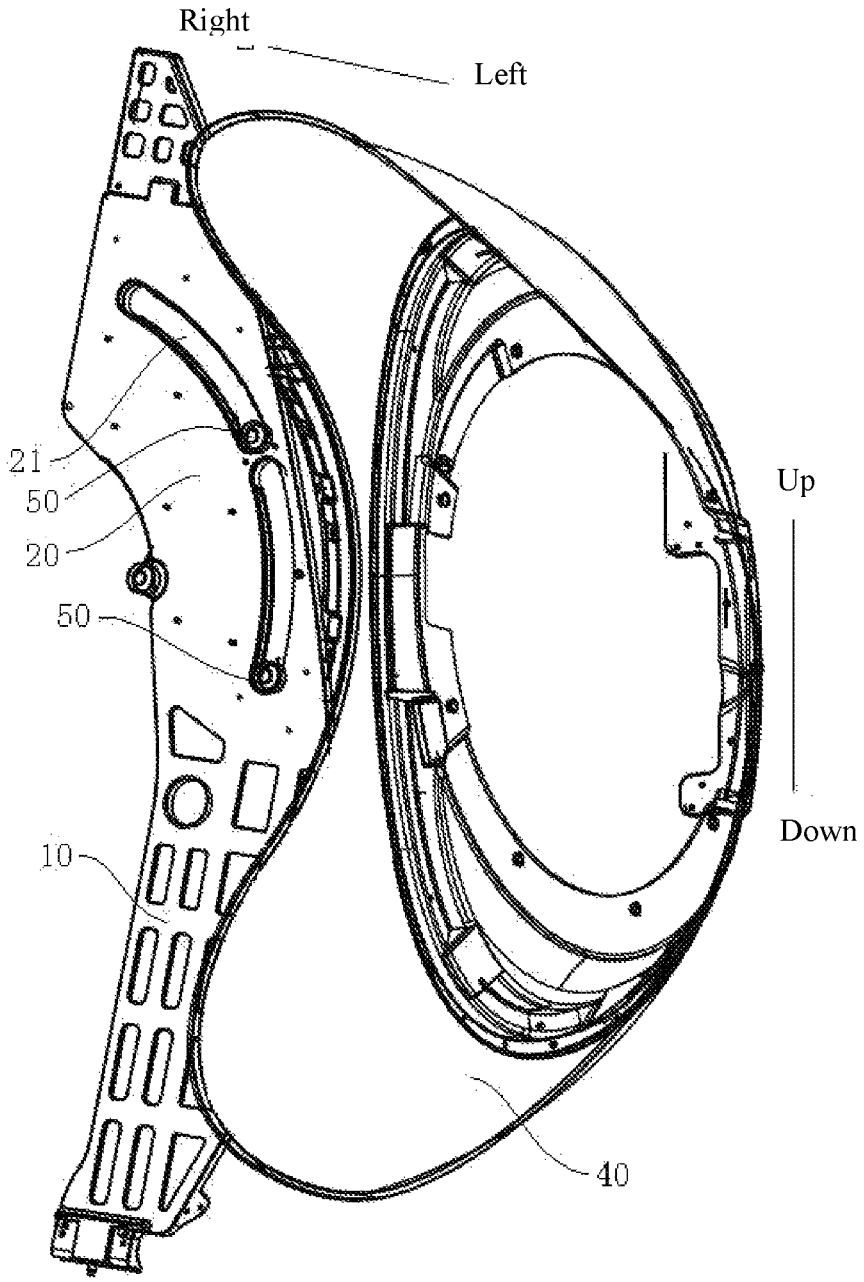
FIG. 5 is a schematic view showing that the track mechanism is mounted on a door unit according to an embodiment of the present disclosure from another angle in accordance with some embodiments.

As shown in FIG. 4 and FIG. 5, according to an embodiment of the present disclosure, the front-loading washing machine further includes the movable portion 50, and the movable portion 50 is configured to move along the track portion 21. The door unit 40 is connected to the movable portion 50 by means of a connecting part. The tub drives the door unit 40 to swing when swinging in the vertical plane, while at the same time, the movable portion 50 on the door unit 40 moves long the track portion 21 of the track mechanism A.

In some examples, the track mechanism A is arranged at one side of the door unit 40 (a right side of the door unit 40 shown in FIG. 4 and FIG. 5). The track body 20 is located at a side of the supporting body 10 facing the door unit 40 (a left side of the supporting body 10 shown in FIG. 5). The track mechanism A is connected to the door unit 40 by means of fit between the movable portion 50 and the track portion 21. The structure is simple and compact, and the connection is reliable.

The track portion 21 may be an arc groove extending along a circumferential direction of a swinging center of the tub. During movement of the door unit 40, the movable portion 50 on the door unit 40 always slides along the track portion 21. The fit between the track portion 21 and the movable portion 50 can used for limiting and further supporting the door unit 40, which improves stability of the structure during operation and use reliability.

In some examples, the movable portion 50 includes a body and a moving end which is rotatable relative to the body. The body is connected to the door unit 40 by means of a connecting part. In some specific examples, the moving end may be fitted over the body and is spaced apart from the body in a radial direction. A rolling body is arranged between the moving end and the body, and the rolling body is a ball. The moving end is configured to be embedded in the track portion 21 and can rotate along with the track portion 21. When the tub swings, the body of the movable portion 50 is stationary relative to the door unit 40, and the moving end rotates relative to the body. The movement is stable and reliable.

In some optional examples, the moving end defines a recess in a portion in contact with the track portion 21, and the recess is fitted with the track portion 21. That is, the moving body of the movable portion 50 may be annular member, the annular member extends along a thickness direction of the base, and two ends of the annular member have sizes larger than that of a middle portion of the annular member. Therefore, the movable portion 50 straddles on the base, such that the recess in the middle portion of the moving end is fitted with an inner wall of the arc groove, which can prevent the movable portion 50 from falling off the base, and further ensures that the fit between the movable portion 50 and the base is reliable.

Of course, the movable portion 50 of the front-loading washing machine is not limited by this, for example, the movable portion 50 may be a pulley straddles on the base, and a shaft of the pulley is connected to the door unit 40 by means of the connecting part.

According to some embodiments of the present disclosure, two track mechanisms A are provided, and the two track mechanisms A are symmetrically arranged at two sides of the cabinet respectively. Specifically, the two track mechanisms A are arranged at a left side and a right side of the door unit 40 respectively, one the track mechanism A is opposite to an inner wall of a left side wall of the cabinet, and the other track mechanism A is opposite to an inner wall of a right side wall of the cabinet. When the tub swings, the door unit 40 moves under guide of the two track mechanisms A, and the structure is stable and reliable.

The front-loading washing machine according to the embodiments the present disclosure is simple and compact in structure, high in use reliability and cost performance, and both the performance requirement and the manufacturing cost are taken in to account.

Other configurations and operations of the front-loading washing machine according to embodiments the present disclosure are known to one of ordinary skill in the art, and will not be described in detail herein.

Reference throughout this specification to "an embodiment," "some embodiments," "exemplary embodiment", "an example," "a specific example," or "some examples," means that a particular feature, structure, material, or characteristic described in connection with the embodiment or example is included in at least one embodiment or example of the present disclosure. Thus, the appearances of the phrases throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that changes, modifications, alternatives, and variations can be made in the above embodiments without departing from principles and purposes of the present disclosure, and the scope of the present disclosure is defined by the claims and their equivalents.

What is claimed is:

1. A track mechanism for a front-loading washing machine, comprising:

a base comprising a supporting body and a track body, the base being provided with a track portion configured to guide a movable body comprising a door unit to move along the track portion, wherein:

the track portion is arranged on the track body, the supporting body and the track body are stacked and combined relative to each other, the supporting body is provided with a guide portion in a corresponding shape and position to the track portion, and wear resistance of a material forming the track body is higher than wear resistance of a material forming the supporting body.

2. The track mechanism according to claim 1, wherein the track portion comprises a plurality of tracks spaced apart from each other.

3. The track mechanism according to claim 1, wherein the supporting body is combined with the track body by means of a connecting member.

4. The track mechanism according to claim 3, wherein the connecting member is a screw.

5. The track mechanism according to claim 1, wherein the supporting body is combined with the track body by embedding or casting in a mold.

6. The track mechanism according to claim 1, wherein the track portion is an arc groove.

7. A front-loading washing machine, comprising:

a cabinet comprising a front panel, the front panel defining an opening;

a tub defining an access port configured to move upwards and downwards in the opening, arranged in the cabinet;

a rotatable drum arranged in the tub;

a door unit mounted to the tub and covering the access port; and a track mechanism comprising a base, the base being provided with a track portion configured to guide the door unit to move along the track portion, wherein the base comprises a supporting body and a track body, the track portion is arranged on the track body, the supporting body and the track body are stacked and combined relative to each other, the supporting body is provided with a guide portion in a corresponding shape and position to the track portion, and wear resistance of a material forming the track body is higher than wear resistance of a material forming the supporting body, and wherein the movable body is the door unit and the door unit moves upwards and downwards in the opening under guide of the track mechanism.

8. The front-loading washing machine according to claim 7, further comprising a movable portion, the movable portion is configured to move along the track portion, and the door unit is connected to the movable portion by means of a connecting part.

9. The front-loading washing machine according to claim 8, wherein the movable portion includes a body and a moving end rotatable relative to the body, the moving end and the body are provided with a rolling body therebetween, and the moving end is configured to be embedded in the track portion and can rotate along the track portion.

10. The front-loading washing machine according to claim 9, wherein the rolling body is a ball.

11. The front-loading washing machine according to claim 9, wherein the moving end defines a recess in a portion in contact with the track portion, and the recess is fitted with the track portion.

12. The front-loading washing machine according to claim 7, wherein two track mechanisms are symmetrically provided at two sides of the cabinet respectively.

* * * * *